US009468057B2

(12) United States Patent
Stöger

(10) Patent No.: US 9,468,057 B2
(45) Date of Patent: Oct. 11, 2016

(54) DEVICE FOR SUPPLYING A PLURALITY OF LED UNITS WITH POWER

(75) Inventor: Christian Stöger, Vienna (AT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 937 days.

(21) Appl. No.: 13/579,860

(22) PCT Filed: Feb. 16, 2011

(86) PCT No.: PCT/EP2011/052274

§ 371 (c)(1),
(2), (4) Date: Oct. 26, 2012

(87) PCT Pub. No.: WO2011/101368

PCT Pub. Date: Aug. 25, 2011

(65) Prior Publication Data

US 2013/0038210 A1 Feb. 14, 2013

(30) Foreign Application Priority Data

Feb. 17, 2010 (DE) ..... 10 2010 008 275

(51) Int. Cl.
*H05B 37/02* (2006.01)
*H05B 33/08* (2006.01)

(52) U.S. Cl.
CPC ..... *H05B 33/083* (2013.01); *H05B 33/0815* (2013.01); *H05B 33/0818* (2013.01)

(58) Field of Classification Search
USPC ..... 315/177, 185 R, 192, 193, 224, 291, 315/297, 299, 301, 307, 308, 311, 312, 313, 315/362
See application file for complete search history.

(56) References Cited

U.S. PATENT DOCUMENTS 6,586,890 B2 * 7/2003 Min ..... B60Q 1/2607 315/224
7,511,436 B2 3/2009 Xu ..... 315/307
7,810,951 B1 * 10/2010 Lee ..... F21V 21/30 362/218

(Continued)

FOREIGN PATENT DOCUMENTS

CN 1784930 A 6/2006 ..... H05B 33/08
DE 102007004877 A1 8/2008 ..... H05B 37/02

(Continued)

OTHER PUBLICATIONS

German Office Action, Application No. 10 2010 008 275.9-34, 3 pages, Nov. 26, 2010.

(Continued)

*Primary Examiner* — Douglas W Owens
*Assistant Examiner* — Jianzi Chen
(74) *Attorney, Agent, or Firm* — Slayden Grubert Beard PLLC

(57) ABSTRACT

A device for supplying a plurality of LED units with power includes a common DC/DC converter which delivers a regulated output voltage and to which a plurality of sections are connected, each having a buck converter and an LED unit connected thereto, and means for regulating or setting the section currents to be supplied to the LED units. In order to simplify the device, the means for regulating or setting the section currents are formed by a central, common processor, which is supplied with actual values in keeping with the individual section currents and connected to corresponding control inputs of the respective buck converters for applying control values calculated on the basis of the actual values.

18 Claims, 3 Drawing Sheets

(56) References Cited

U.S. PATENT DOCUMENTS

| | | | | |
|---|---|---|---|---|
| 2003/0102819 | A1* | 6/2003 | Min | B60Q 1/2607 315/291 |
| 2006/0158160 | A1* | 7/2006 | Friedrich | H02M 3/156 323/222 |
| 2006/0238174 | A1 | 10/2006 | Russell et al. | 323/229 |
| 2006/0261752 | A1 | 11/2006 | Lee | 315/291 |
| 2008/0224636 | A1 | 9/2008 | Melanson | 315/307 |
| 2009/0189530 | A1* | 7/2009 | Ashdown | H05B 33/0818 315/152 |
| 2013/0038210 | A1 | 2/2013 | Stöger | 315/88 |

FOREIGN PATENT DOCUMENTS

| | | | | |
|---|---|---|---|---|
| DE | 102008060042 | A1 | 9/2009 | B60Q 1/00 |
| WO | 2004/049198 | A1 | 6/2004 | G06F 17/30 |
| WO | 2009/072058 | A2 | 6/2009 | H05B 33/08 |
| WO | 2009/095865 | A2 | 8/2009 | H05B 33/08 |
| WO | 2010/004475 | A1 | 1/2010 | H05B 33/08 |
| WO | 2011/101368 | A2 | 8/2011 | |

OTHER PUBLICATIONS

International Search Report and Written Opinion, Application No. PCT/EP2011/052274, 8 pages, Mar. 5, 2012.

Chinese Office Action, Application No. 201180010072.9, 9 pages, Jun. 27, 2014.

* cited by examiner

DEVICE FOR SUPPLYING A PLURALITY OF LED UNITS WITH POWER

CROSS-REFERENCE TO RELATED APPLICATIONS

This application is a U.S. National Stage Application of International Application No. PCT/EP2011/052274 filed Feb. 16, 2011, which designates the United States of America, and claims priority to German Application No. 10 2010 008 275.9 filed Feb. 17, 2010, the contents of which are hereby incorporated by reference in their entirety.

TECHNICAL FIELD

This disclosure relates to a device for supplying power to a plurality of LED units, comprising a common DC/DC converter, which outputs an output voltage subjected to closed-loop control and to which a plurality of sections in each case with a buck converter and an LED unit connected thereto, are connected, and comprising means for the closed-loop control or adjustment of the section currents to be supplied to the LED units.

BACKGROUND

In recent lighting devices, in particular also in lighting systems for motor vehicles, light-emitting diodes (LEDs) are being used to an increased extent. Such LED lighting devices have many advantages, such as small dimensions, low power requirement etc., but, in contrast to conventional light-emitting means, they require a certain current firstly to achieve a certain brightness and secondly to emit a certain color. Therefore, it is conventional in LED lighting systems to adjust the light color via the current and the desired brightness via a pulse-width-modulated (PWM) power supply. For this purpose, in practice corresponding control devices, in particular with DC/DC converters, are known, wherein an output voltage which is subjected to closed-loop control can also be output by these DC/DC converters.

However, it is frequently also desirable to supply power to and drive a large number of LEDs, for example individually or interconnected in groups, wherein the LEDs can also be of different types. Such individual LEDs or LEDs interconnected in groups are referred to generally here as LED units.

In the case of a plurality of LED units, efficient and cost-effective driving is desirable, in which case it is necessary to deal with the problem of correcting different voltage values with superimposed interference, which can occur in an on-board power supply system of a motor vehicle, for example, in such a way that the LEDs do not produce any flickering light.

In practice, at present a dedicated controller is connected upstream of each LED or each group of LEDs, i.e. each LED unit, in order to subject the individual section currents for the respective LED units to closed-loop control. If, for example, five sections or five LED units are now provided, which is a conventional value in the context of lighting systems for motor vehicles, there is then the need to also provide five controllers for the individual five sections or LED units. Secondly, fluctuations and interference in supply voltage (on-board power supply system) are generally corrected via a DC/DC converter, whose output voltage is above its maximum output voltage. Such a converter with an increased output voltage is generally referred to as a boost converter, whereas a step-down DC/DC converter is generally referred to as a buck converter.

The boost converters used in practice for this purpose achieve a good level of efficiency given suitable dimensions. However, one problem consists in that, at a given current flowing through a plurality of LEDs, different voltage drops across the LEDs can be provided owing to differences in the LEDs. As mentioned, the current through the LEDs is also of significance for the light color to be emitted. For example, when a current of equal value is flowing through two series-connected LEDs, there may be a different voltage drop across each of these two LEDs. It is therefore necessary to provide a separate current at least for each section, for each LED unit.

SUMMARY

In one embodiment, a device for supplying power to a plurality of LED units comprises a common DC/DC converter, which outputs an output voltage subjected to closed-loop control and to which a plurality of sections in each case with a buck converter and an LED unit connected thereto, are connected, and comprising means for the closed-loop control or adjustment of the section currents to be supplied to the LED units, wherein the means for the closed-loop control or adjustment of the section currents are formed by a central, common arithmetic logic unit, which receives actual values supplied corresponding to the individual section currents and is connected to corresponding control inputs of the respective buck converters for the application of manipulated variables calculated on the basis of the actual values.

In a further embodiment, the arithmetic logic unit is also connected on the output side to PWM switching means of the LEDs. In a further embodiment, the arithmetic logic unit is designed to determine the manipulated variables on the basis of the PWM duty factors. In a further embodiment, the arithmetic logic unit is designed to drive the individual buck converters in a time multiplexing method. In a further embodiment, the buck converters have a supply-related embodiment, wherein a switch of each buck converter, said switch being driven by the arithmetic logic unit, is connected in series with a diode in the reverse direction between a power supply line and ground. In a further embodiment, the current through the switch is used for the actual value detection. In a further embodiment, the voltage drop across a resistor arranged in series with the switch which is brought about by the current flowing through said switch is measured for the actual value detection. In a further embodiment, the actual value is determined synchronously with a respective disconnection of the switch. In a further embodiment, the DC/DC converter is transferred into a device which is separate from the buck converters with the LED units. In a further embodiment, at least one LED unit has a section voltage, at operating current, which is in the region of the minimum input voltage of the DC/DC converter or below this, as a result of which emergency lighting is implemented in the event of failure of the DC/DC converter.

BRIEF DESCRIPTION OF THE DRAWINGS

Example embodiments will be explained in more detail below with reference to figures, in which.

DETAILED DESCRIPTION

Figure 1:
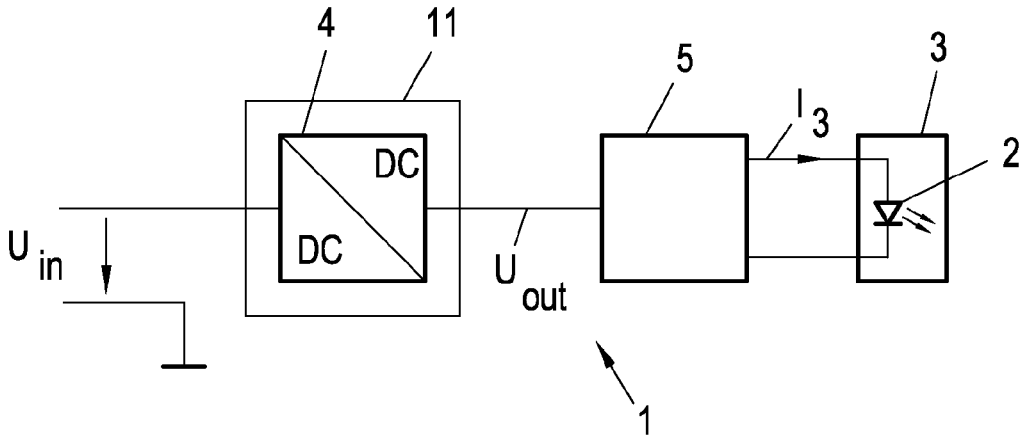
FIG. 1 shows a schematic of the principle design of a device for supplying power to LEDs, comprising a DC/DC converter (boost converter) and, by way of example, a buck converter.

Certain embodiments of the invention are based on one or more of the following considerations:

1. Owing to characteristic data, the approximate parameters relating to LEDs are present; at least these parameters can be determined computationally.
2. The current to be set (section current) for each LED unit is known.
3. The LEDs can be switched on and off (dimmed) in groups or individually in a conventional manner via pulse width modulation (PWM).
4. Finally, the voltage drop across the LEDs is variable only owing to thermal influences, which is of particular significance.

This means that the at least approximate parameter values are present or can be calculated, and that the supply voltage through the upstream converter is fixed; changes in the closed-loop control are moreover only influenced thermally, wherein relatively large time constants result (the thermally influenced changes are slow processes). Therefore, complex closed-loop control measures with quick-action controllers per section or LED unit could be unnecessary.

Some embodiments provide a device as mentioned at the outset which makes it possible to reduce the circuitry complexity and results in a substantial cost saving.

In some embodiments, the means for the closed-loop control or adjustment of the section currents are formed by a central, common arithmetic logic unit, which receives actual values supplied corresponding to the individual section currents and is connected to corresponding control inputs of the respective buck converters for the application of manipulated variables calculated on the basis of the actual values.

Thus, in some embodiments, the driving of the buck converters is performed by an arithmetic logic unit instead of separate controllers or closed-loop control ICs, as has previously been considered necessary. That is to say that since only thermal processes need to be corrected, a correction time constant of from approximately 10 ms to 100 ms, for example, is sufficient. As a result, it is therefore possible to use an arithmetic logic unit, which is controlled by an individual microcontroller, for example, for many channels or sections, for example even for 16 sections or LED units, each having a buck converter and the actual LED section (the LED unit). Therefore, in the present device, a buck converter, whose control input is connected to a common, central arithmetic logic unit instead of a dedicated, separate controller, is connected to the output voltage, which is subjected to closed-loop control, of the DC/DC converter for each section. The arithmetic logic unit can in this case be implemented by the microcontroller or microcomputer already provided in the respective control device, i.e. can be provided by a sequence in this microcontroller of the control device. In comparison with a conventional device with, for example, five LED units or sections, a saving of four controller circuits or closed-loop control ICs is therefore made, and, moreover, the implementation of the common arithmetic logic unit may also be more cost-effective or advantageous in comparison with a single remaining controller.

In order to bring about the respective actual values, suitable measurement circuits, such as measuring resistors, current-to-voltage converters or the like, as are known per se, can be used. The arithmetic logic unit then calculates corresponding manipulated variables for the respective buck converters on the basis of these section current actual values and on the basis of parameter data stored in tables, for example.

Furthermore, in some embodiments, the arithmetic logic unit can perform both the above-described closed-loop control function, or actually more precisely the actuating function, and the dimming of the LEDs by means of PWM, wherein it is also possible for the arithmetic logic unit to determine precisely whether the respective buck converter actually needs to operate at the given time or not. Thus, in some embodiments the arithmetic logic unit is also connected to PWM switching means of the LEDs on the output side.

Furthermore, the arithmetic logic unit may be configured to determine the manipulated variables on the basis of the PWM duty factors. If individual LEDs in a section are dimmed, for example by parallel-connected transistors or other switching elements which take over the current when an LED is intended to be disconnected, i.e. short-circuited, the manipulated variable of the "control loop" can be calculated in a simple manner in this way, wherein the new working point is also immediately available approximately correctly; in the present device, it is therefore not necessary for a controller to be approached from far away. This also prevents an excess current from occurring in the LED section, which excess current could possibly damage LEDs.

The arithmetic logic unit can also distribute the switch-on times of the buck converters of the various LED sections temporally in such a way that as uniform loading as possible of the converter output voltage which has been subjected to closed-loop control is achieved. Thus, in some embodiments the arithmetic logic unit is designed to drive the individual buck converters in a time multiplexing method.

Further, the buck converters may have a supply-related embodiment, wherein a switch of each buck converter, said switch being driven by the arithmetic logic unit, is connected in series with a diode in the reverse direction between a power supply line and ground. In contrast to a ground-related buck converter, which has a supply-side switch, for example a switching transistor, in the case of a supply-related buck converter, the switch is not connected to the supply, but to ground, which may provide technological advantages.

In some embodiments, in order to detect the respective current actual value, a dedicated measurement circuit is not required, but rather the current through the switch provided in the converter itself can be measured since the current through the switch is equal to the current through the LED section when the buck converter is driven by the arithmetic logic unit. This current therefore represents the controlled variable when the switch is switched on. As a result, not only are savings made on component parts, but the efficiency of the buck converter is also increased. Thus, in some embodiments the current through the switch is used for the actual value detection, wherein a voltage drop across a resistor arranged in series with the switch, which voltage drop is brought about by this current, is measured.

In this case, the current actual value may be determined synchronously with a respective disconnection of the switch. That is to say that if the current value is measured synchronously with the disconnection time, the component complexity can be reduced further and, apart from the lower costs and the lower space requirement, primarily also the tolerance chain can be reduced, as a result of which the accuracy of the measurement is also increased. In the case of the supply-related buck converter, the measuring resistor (shunt) may be present on the ground side, which is why its voltage drop can be applied directly to an A/D input of the arithmetic logic unit.

In some embodiments the DC/DC converter is transferred into a remote device which is separate from the buck converters with the LED units. Given such an embodiment, the voltage which has been subjected to closed-loop control or the closed-loop current control can be provided by means which are arranged separately, with the result that the power loss occurring in this means does not arise where the driving of the LED lighting itself takes place. In particular in motor vehicles, inhospitable environmental conditions prevail there, such as a high level of heat as a result of the engine, for example. In some embodiments, the control device itself which is associated directly with the LED lighting only produces a small amount of heat because, for example, the converter (boost converter) has been transferred to a remote device.

Finally, in some embodiments at least one LED unit has a phase voltage, at operating current, which is in the region of the minimum input voltage of the DC/DC converter or below this, as a result of which emergency lighting is implemented in the event of failure of the DC/DC converter. If, therefore, at least one LED section has a section voltage at the required current which is in the region of the minimum input voltage of the voltage converter or below this, the emergency lighting can be realized in the event of failure of this voltage converter since, in this case, approximately the input voltage is present at the output of the converter owing to the converter topology.

FIG. 1 shows, very schematically, a principle design of a device 1 for supplying power to LEDs, wherein FIG. 1 shows an LED 2 in a single LED unit 3 merely by way of example and schematically. The device 1 contains a DC/DC converter 4, with this DC/DC converter 4 being in the form of a so-called boost converter, i.e. its output voltage $U_{out}$ is above its input voltage $U_{in}$. In the case of an LED lighting system for a motor vehicle, the input voltage $U_{in}$ is the on-board power supply system voltage, which may be between 9 V and 16 V, for example.

The output voltage $U_{out}$ of the boost converter 4 is supplied for a further converter, a so-called buck converter 5, which for its part drives the LED unit 3. In this case, a current $I_3$ which has been subjected to closed-loop control is supplied to the LED unit 3. This closed-loop current control is therefore important since the light color of the respective LED 2 is adjusted via the current. Accordingly, in the case of a plurality of LED units 3 (cf. FIG. 3), dedicated closed-loop current control and therefore a dedicated buck converter 5 needs to be provided for each LED unit 3. As mentioned, for reasons of simplicity, FIG. 1 shows only a single LED unit 3 with an associated buck converter 5.

Figure 2:
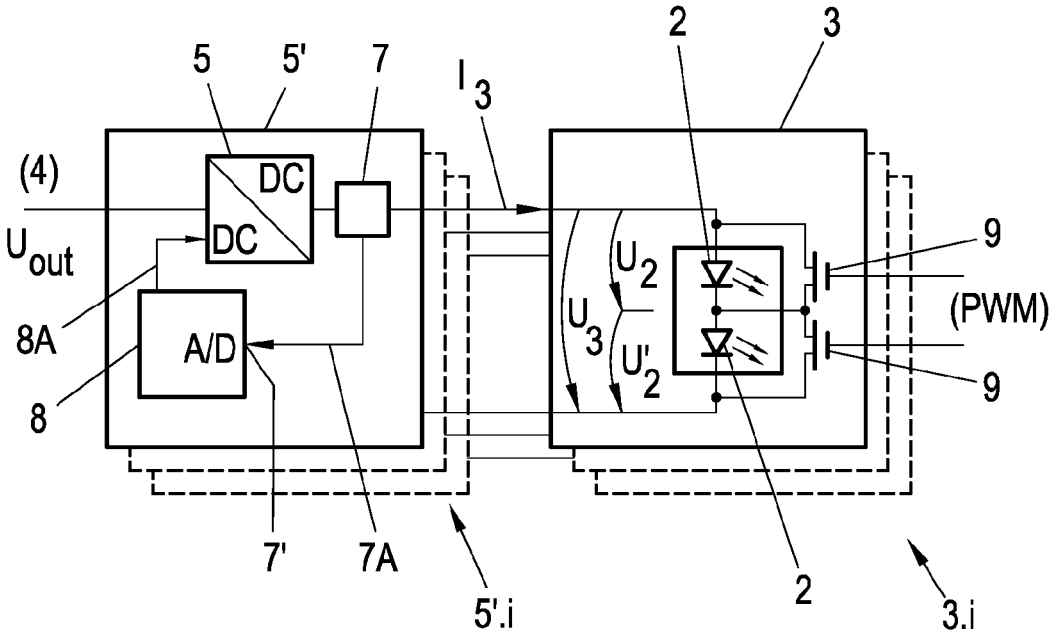
FIG. 2 shows a slightly more detailed circuit diagram of a buck converter and an LED unit connected thereto, by way of example here with two LEDs connected in series, to each of which a parallel-connected switch in the form of a field effect transistor for the purpose of dimming by means of PWM is associated.
Figure 3:
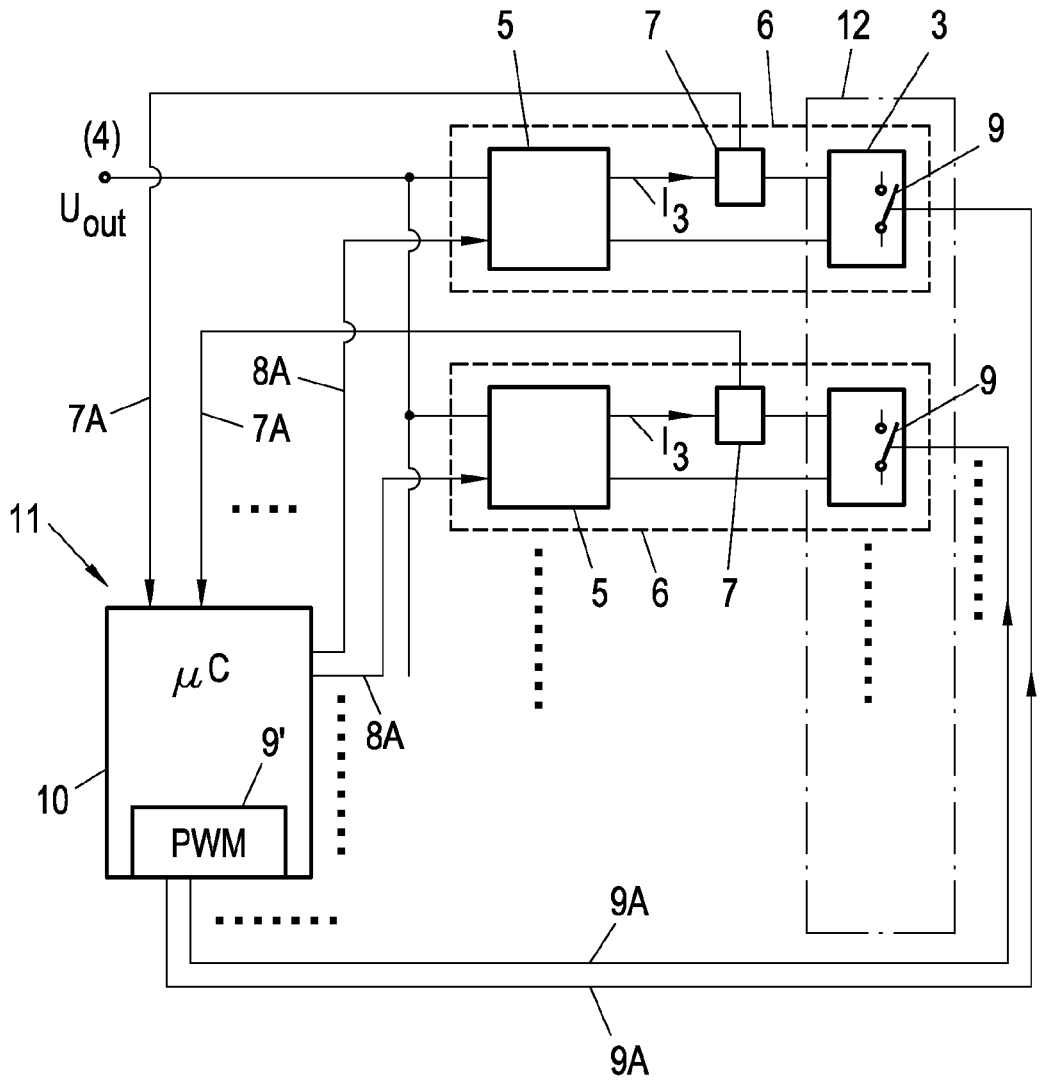
FIG. 3 shows a schematic of part of a device for LED power supply, as illustrated in principle in FIG. 1, but now with a plurality of sections or LED units and a common arithmetic logic unit, but without the input-side DC/DC converter.

FIG. 2 shows, in more detail, an exemplary circuit of a buck converter 5 together with an LED unit 3 so as to form a section or channel 6, cf. in this regard also the illustration in FIG. 3, in which a plurality of such sections or channels 6, each having a buck converter 5 and an LED unit 3 and furthermore a measurement circuit 7, are illustrated.

Such a measurement circuit 7 is also shown in FIG. 2, and this measurement circuit 7 is used to detect the current actual value $I_3$, wherein a corresponding actual value variable is applied, in a conventional manner per se, to means 8 for the closed-loop control or adjustment of the section currents $I_3$, referred to below as closed-loop control unit 8, for short, with a suitable A/D input 7', as is indicated at 7A in FIG. 2. A corresponding manipulated variable 8A is then supplied to the buck converter 5 for the closed-loop current control.

On the other side, this buck converter 5 receives the output voltage $U_{out}$, which has been subjected to closed-loop control, of the boost converter 4 (see FIG. 1) which is not illustrated in any more detail in FIG. 2.

In FIG. 2, the buck converter 5, the measurement circuit 7 and the closed-loop control unit 8 are combined in a converter circuit 5', in one block, and it is indicated schematically at 5'.*i* as well as at 3.*i* that a plurality of such circuits 5' or LED units 3, therefore a plurality of channels or sections 6, are connected in parallel with one another.

FIG. 2 also shows, in the region of the LED unit 3, that there is a voltage drop $U_2$ or $U_2'$ across the two LEDs 2, for example. The sum of these two voltage drops $U_2$, $U_2'$ (and possibly further voltage drops in the case of a plurality of LEDs 2 in the LED unit 3) gives the total voltage $U_3$ across the LED unit 3. The individual voltage drops $U_2$, $U_2'$ can now be different from one another depending on the individual LEDs 2, even if one and the same current $I_3$ is flowing through the LEDs 2. The LEDs are conventionally sorted by the LED manufacturer in such a way that, at a given current $I_3$, the desired light color is emitted. However, what is usually not sorted is the voltage drop $U_2$, $U_2'$ occurring across the LED 2. As a result, each LED unit 3 and therefore each section or channel 6 has a different voltage drop $U_3$ given the same current $I_3$. The classification into "relatively small" groups of LEDs 2 generally has a functional background or else the reasoning that the section voltage does not exceed the "touch voltage limit" which is determined differently in industry standards.

A current $I_3$ which is subjected to extra closed-loop control is now provided for each LED unit 3, therefore for each section or channel 6. This makes it possible for the individual LEDs 2 to emit the desired light color (for which, as mentioned, the current is the decisive factor).

Then, still in the region of the LED unit 3, it is indicated by means of switches 9 in FIG. 2 that the respective LEDs 2, with which the switches 9 are connected in parallel, can be dimmed individually (possibly also groupwise) via pulse width modulation (PWM). Via this PWM, the brightness is adjusted, by virtue of the duty factor during switch-on and switch-off of the LEDs 2, as is known per se. In particular, a PWM unit 9', such as is indicated within an arithmetic logic unit 10, for example, in FIG. 3, is provided for this PWM driving.

The approximate parameters of the LEDs 2 are known or can be calculated without any problems; the supply voltage, i.e. the output voltage $U_{out}$ of the DC/DC converter 4, is also fixed; changes in the individual closed-loop control operations of the sections 6 are thus influenced only thermally, with these changes being slow processes, i.e. having large time constants. This means that the individual buck converters 5 of the sections 6 can be adjusted or driven by a central, common arithmetic logic unit 10, as is shown in FIG. 3, instead of by in each case one dedicated closed-loop control unit 8. A correction time constant of approximately 10 ms to 100 ms, for example, is sufficient for correction of such slow thermal processes. This means that an electronic arithmetic logic unit 10, for example with a microcontroller, is sufficient even for a relatively large number of channels or sections 6 (for example for 16 sections 6), each having a buck converter 5 and an LED unit 3. Accordingly, a single buck converter 5 is connected to the output voltage $U_{out}$, which has been subjected to closed-loop control, of the DC/DC boost converter 4 for each section 6, and the arithmetic logic unit 10 is used for the closed-loop control or control of the plurality of buck converters 5. This arithmetic logic unit 10 can be implemented, for example, by a sequence in the microcontroller of a control device 11, wherein this control device 11 can also contain the boost converter 4, for example, as is indicated schematically in FIG. 1, and wherein this control unit 11 is a device which is remote from the respective sections 6 and which is fitted at a suitable point (for example in a motor vehicle). This physical separation of the device 11 from the individual sections 6 may provide or ensure that disadvantageous environmental conditions, such as for example in the vicinity of an engine with a high level of heating, do not have any or have little unfavorable effect on the driving of the LEDs 2 overall.

Fifteen separate closed-loop control units or closed-loop control ICs comparable to the unit 8 in FIG. 2 can be dispensed with, for example, in the case of a device 1 having channels or sections 6 by virtue of the provision of a common, central arithmetic logic unit 10 for all sections 6 with LED units 3.

The detection of the actual variable, i.e. the current $I_3$, per section 6 is still performed via a suitable measurement circuit, such as the measurement circuit 7 in FIG. 2, for example.

As mentioned, FIG. 3 shows the common arithmetic logic unit 10 in association with a plurality of sections or channels 6, illustrated by dashed lines, each having a buck converter 5, a measurement circuit 7 and an LED unit 3, for example with a PWM switch 9 (which is only illustrated very schematically as a switch in each case). The plurality of LED units 3 is combined to form a lighting unit 12, which is shown as a block with dash-dotted lines.

Specifically, FIG. 3 shows two sections 6, but it is indicated that a plurality of such sections, for example 16 sections, are provided. In each section, an actual value feed line 7A passes from the respective measurement circuit 7 to the arithmetic logic unit 10 in order to supply the actual values of the individual section currents $I_3$ there. On the other side, adjustment connections 8A between the central arithmetic logic unit 10 and the individual buck converters 5 of the sections 6 are illustrated. In addition, as has been mentioned, FIG. 3 shows that the PWM unit 9' is also implemented in the arithmetic logic unit 10, wherein corresponding driving operations 9A for the switches 9 (which can be implemented by field effect transistors, for example, as can be seen from FIG. 2) are shown. Owing to the simultaneous implementation of the PWM driving in the arithmetic logic unit 10, said arithmetic logic unit always knows whether the buck converter needs to be operating at that time, i.e. needs to be in operation, for a respective section 6 or not because the switch 9 of the associated LED unit is closed; as a result, computation capacity in the arithmetic logic unit 10 can also be saved.

The arithmetic logic unit 10 can also calculate the respective manipulated variable 8A quickly when individual LEDs 2 in a section 6 or a unit 3 are dimmed, for example by parallel-connected transistors, as shown in FIG. 2, possibly also by other switching elements which take over the current when the respective LED 2 is intended to be "turned off", wherein the new working point is immediately available approximately correctly. By way of contrast, the new working point would need to be "approached" from relatively far away in the case of individual closed-loop control units. In this way it is also possible by means of the common arithmetic logic unit 10 to prevent an excess current, i.e. an excessively high current $I_3$, from occurring in the respective section 6, which excess current could damage the LEDs 2.

Figure 4:
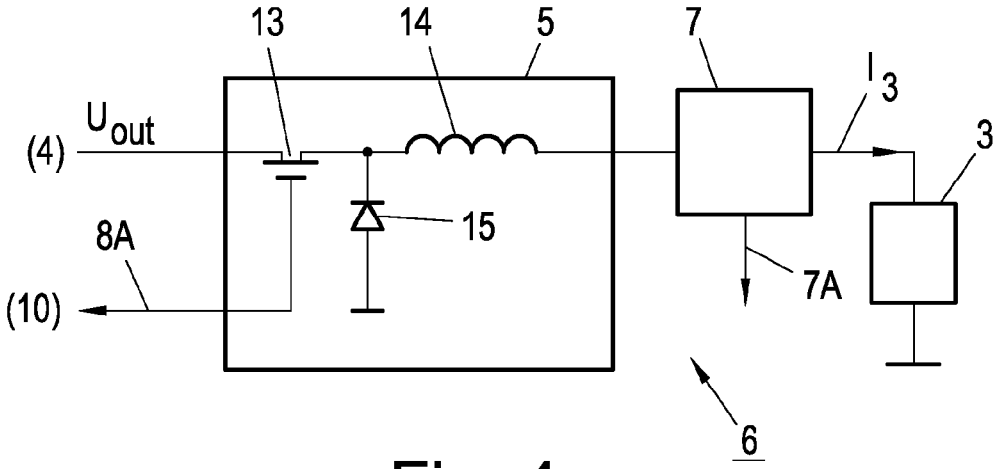
FIG. 4 shows a detail circuit diagram of a ground-related buck converter with a dedicated measurement circuit connected and an LED unit.

FIG. 4 shows a single section 6 with a buck converter 5, which is in this case a ground-related buck converter, with a measurement circuit 7 and with an LED unit 3. The buck converter 5 with the ground-related embodiment has a supply-side switching transistor or generally switch 13, which is driven by the arithmetic logic unit 10 (not shown in FIG. 4 but see FIG. 3) via the control or switching input 8A. A storage inductance 14 is connected in series with the switch 13, and a diode 15 prevents the storage inductance 14 from discharging in the incorrect direction. This diode 15 is connected with one cathode to ground, in the same way as the LED unit 3 is connected to ground at the end remote from the storage inductance 14 or the measurement circuit 7. Such a circuit for a buck converter 5 is known per se and does not require any further explanation here. The magnitude of the coil current and therefore the section current $I_3$ is adjusted via the switch 13, by means of the on and off ratio, i.e. the duty factor. This current $I_3$ is detected by the measurement circuit 7, and the actual value is supplied to the arithmetic logic unit 10 (see FIG. 3) at 7A.

The measurement circuit 7 can have any desired known embodiment per se, for example with measurement of a voltage drop across a shunt, with a current-to-voltage converter or similar means.

Figure 5:
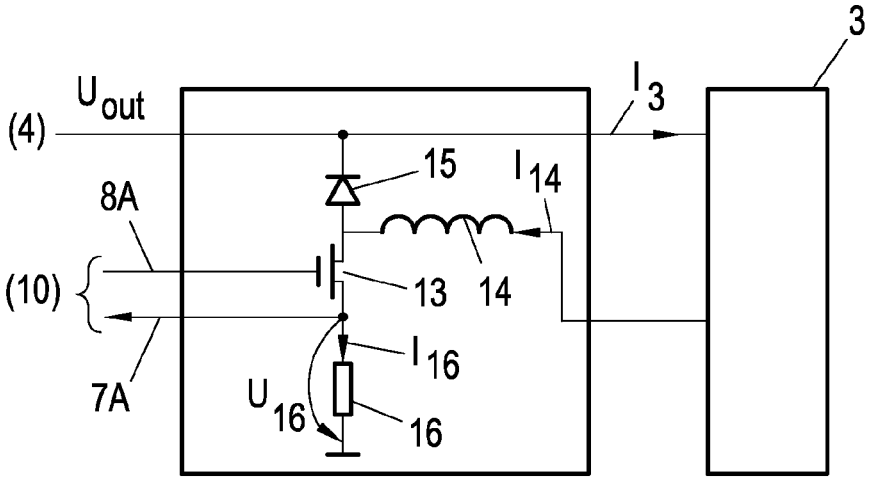
FIG. 5 shows, as an alternative to FIG. 4, an embodiment with a supply-related buck converter together with a connected LED unit.

FIG. 5 shows an example of such a measurement circuit 7 with a measuring resistor 16.

Specifically, FIG. 5 shows, in a comparable manner, a section 6 with a buck converter 5 and an LED unit 3 in a schematic illustration. The buck converter 5 has a supply-related embodiment here, however, wherein the supply voltage $U_{out}$, which is supplied by the boost converter 4 (see FIG. 1), is applied directly to the LED unit 3. The closed-loop current control in the buck converter 5, on the other hand, takes place via a shunt arm, wherein the switch 13 (for example in turn a transistor, in particular a FET) is arranged in this shunt arm, with the diode 15 being connected in series with said switch. The storage inductance 14, which is arranged in a return line from the LED unit 3, is connected to the node between the switch 13 and the diode 15.

The switch 13 is connected to ground via a measuring resistor (shunt) 16, with the result that the current flowing through the switch 13 flows as current $I_{16}$ through the resistor 16 in the measurement circuit 7 and thus causes a voltage drop $U_{16}$ across this resistor 16 which is supplied as measured variable (actual value variable) at 7A to the arithmetic logic unit 10 (likewise not illustrated in any more detail in FIG. 5). The arithmetic logic unit 10 in turn produces, on the other side, at 8A, the manipulated variable, i.e. the switching signal for switching the switch 13 on and off in order to implement the desired closed-loop current control.

Figure 6:
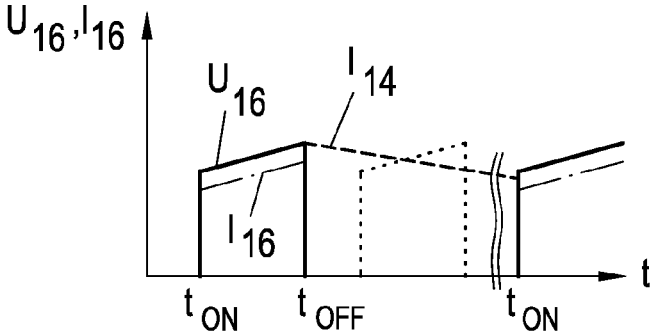
FIG. 6 shows an associated current or voltage graph, wherein a time-shifted switch-on/switch-off of another section is indicated by dashed lines.

FIG. 6 shows a graph illustrating the profile of the current $I_{16}$ through the measuring resistor 16 and the voltage drop $U_{16}$ across the resistor 16, wherein a switch-off time of the switch 13 initiated by the switching signal 8A is illustrated by the time $t_{OFF}$. It is shown that, after switch-on $t_{ON}$, the current $I_{16}$ through the resistor 16 (see the dash-dotted line in FIG. 6) and therefore the voltage $U_{16}$ across the resistor 16 increases approximately linearly up to the switch-off time $t_{OFF}$. Then, the coil current $I_{14}$ decreases, as shown by the dashed line in FIG. 6, until the next time the switch 13 is switched on.

With a time shift with respect thereto, the switch-on and switch-off of the switch 13 in the associated buck converter 5 can now be initiated in another section 6 by the arithmetic logic unit 10, as is shown schematically in FIG. 6 by the dotted line. In this way, uniform loading of the supply voltage $U_{out}$ which has been subjected to the closed-loop control can be achieved in the manner of a time multiplexing method, by distributing the switch-on and switch-off times of the buck converters 5 of the various sections 6.

The embodiment shown in FIG. 5, with the supply-related buck converter 5, in which the switch 13 is no longer connected to the supply voltage, but to ground, advantageously provides a direct measurement circuit 7, i.e., the avoidance of a dedicated measurement circuit 7 as shown in FIG. 4, since simply the current $I_{16}$ through the switch 13 can be measured. This current through the switch 13 is equal to the current $I_{16}$ and in particular equal to the current $I_3$ through the section 6 when the buck converter 5 is triggered by the arithmetic logic unit 10 (switching signal 8A); this current through the switch 13 and therefore through the measuring resistor 16 therefore represents the controlled variable (i.e. the section current $I_3$) when the switch 13 is switched on. With such an embodiment, not only is there a saving of dedicated components, but there is also an increase in the efficiency of the buck converter 5.

In some embodiments the current value $I_{16}$ or proportionally the voltage drop $U_{16}$ is measured in synchronism with the respective switch-off time $t_{OFF}$ (see FIG. 6), which can be implemented in a simple manner with the aid of the arithmetic logic unit 10, which does determine the switch-off time via the control signal 8A. As a result, the complexity involved in the current measurement is further reduced, the tolerance chain is reduced owing to the reduction in the number of components, and the accuracy of the measurement is increased. Since in the case of the supply-related buck converter 5, as shown in FIG. 5, the shunt, i.e. measuring resistor 16, is connected to ground, the voltage drop $U_{16}$ across said measuring resistor can be applied directly to an appropriate analog-to-digital converter input of the arithmetic logic unit 10 (see actual value feed line 7A in FIG. 3).

In some embodiments, at least one section 6, with an LED unit 3, has a section voltage given the required current $I_3$ which is below or around the minimum input voltage $U_{in}$ of the input-side, common boost converter 4. As a result, in the event of failure of this boost converter 4, at least emergency lighting can be implemented, in which case approximately the input voltage $U_{in}$ is present at the output of said boost converter, as output voltage $U_{out}$, owing to the conventional boost converter topology.

The invention claimed is:

1. A device for supplying power to a plurality of LED units, comprising:

a common DC/DC converter that outputs a regulated output voltage;

a plurality of sections connected to the common DC/DC converter, each section having a buck converter and an LED unit connected thereto; and a central, common processor configured to regulate section currents supplied to the LED units, by:

receiving actual values corresponding to the individual section currents;

calculating control values based on the received actual values; and applying the calculated control values to the respective buck converters via corresponding control inputs of the respective buck converters;

wherein at least one LED unit has a section voltage, at operating current, which is at or below a minimum input voltage of the DC/DC converter, as a result of which emergency lighting is implemented in the event of failure of the DC/DC converter.

2. The device of claim 1, wherein the processor is also connected on an output side to pulse-width-modulated switching means of the LEDs.

3. The device of claim 2, wherein the processor is configured to calculate the control values based on the pulse-width-modulated duty factors.

4. The device of claim 1, wherein the processor is configured to drive the individual buck converters in a time multiplexing method.

5. The device of claim 1, wherein each buck converter comprises a switch that is driven by the processor, the switch being connected in series with a diode in a reverse direction between a power supply line and a ground.

6. The device of claim 5, wherein the actual value for a particular section current corresponds to a current through the respective switch.

7. The device of claim 6, wherein the actual value corresponds to a measured voltage drop across a resistor arranged in series with the respective switch, the voltage drop associated with the current flowing through said switch.

8. The device of claim 6, wherein the actual value is determined synchronously with a disconnection of the switch.

9. The device of claim 1, wherein the DC/DC converter is transferred into a device that is separate from the buck converters and the LED units.

10. A method for regulating currents provided to a plurality of LED units in a device including a common DC/DC converter that outputs a regulated output voltage, a plurality of sections connected to the common DC/DC converter, each section having a buck converter and an LED unit connected thereto, and a central, common processor configured to regulate section currents supplied to the LED units, the method comprising:

the processor receiving actual values corresponding to the individual section currents;

the processor calculating control values based on the received actual values; and the processor applying the calculated control values to the respective buck converters via corresponding control inputs of the respective buck converters;

wherein at least one LED unit has a section voltage, at operating current, which is at or below a minimum input voltage of the DC/DC converter, as a result of which emergency lighting is implemented in the event of failure of the DC/DC converter.

11. The method of claim 10, wherein:

the processor is also connected on an output side to pulse-width-modulated switching means of the LEDs, and the method further comprises the processor calculating the control values based on the pulse-width-modulated duty factors.

12. The method of claim 10, comprising the processor driving the individual buck converters in a time multiplexing method.

13. The method of claim 10, wherein each buck converter comprises a switch that is driven by the processor, the switch being connected in series with a diode in a reverse direction between a power supply line and a ground.

14. The method of claim 13, wherein the actual value for a particular section current corresponds to a current through the respective switch.

15. The method of claim 14, wherein the actual value corresponds to a measured voltage drop across a resistor arranged in series with the respective switch, the voltage drop associated with the current flowing through said switch.

16. The method of claim 14, comprising determining the actual value synchronously with a disconnection of the switch.

17. The method of claim 10, comprising transferring the DC/DC converter into a device that is separate from the buck converters and the LED units.

18. A method for regulating currents provided to a plurality of LED units in a device including a common DC/DC converter that outputs a regulated output voltage, a plurality of sections connected to the common DC/DC converter, each section having a buck converter and an LED unit connected thereto, and a central, common processor, the method comprising:

the processor receiving actual values corresponding to the individual section currents;

the processor calculating control values based on the received actual values;

the processor applying the calculated control values to the respective buck converters via corresponding control inputs of the respective buck converters;

determining at least one LED unit has a section voltage at or below a minimum input voltage of the DC/DC converter; and in response, automatically implementing emergency lighting.

* * * * *